US005831395A

United States Patent [19]

Mortimer et al.

[11] Patent Number: 5,831,395

[45] Date of Patent: Nov. 3, 1998

[54] THREE-WAY FLUORESCENT ADAPTER

[75] Inventors: George W. Mortimer; Bryce L. Hesterman, both of Fort Wayne, Ind.

[73] Assignee: MagneTek, Inc., Nashville, Tenn.

[21] Appl. No.: 585,399

[22] Filed: Jan. 11, 1996

[51] Int. Cl.[6] ..... H05B 37/02

[52] U.S. Cl. ..... 315/307; 315/324; 315/DIG. 7; 315/209 R; 315/DIG. 4

[58] Field of Search ..... 315/201, DIG. 7, 315/308, 307, 209 R, 291, 324, 56, 71, DIG. 4

[56] References Cited

U.S. PATENT DOCUMENTS

| | | | |
|---|---|---|---|
| 3,028,523 | 4/1962 | Seid | 315/201 |
| 4,383,204 | 5/1983 | Roberts | 315/291 |
| 4,950,959 | 8/1990 | Beckrot et al. | 315/DIG. 7 |
| 4,963,795 | 10/1990 | Nilssen | 315/205 |
| 5,101,142 | 3/1992 | Chatfield | 315/308 |
| 5,146,139 | 9/1992 | Nilssen | 315/205 |
| 5,175,477 | 12/1992 | Grissom | 315/291 |
| 5,309,062 | 5/1994 | Perkins et al. | 315/53 |
| 5,341,067 | 8/1994 | Nilssen | 315/209 R |
| 5,424,610 | 6/1995 | Pelton | 315/58 |

*Primary Examiner*—Benny Lee
*Assistant Examiner*—Michael Shingleton
*Attorney, Agent, or Firm*—Waddey & Patterson; Mark J. Patterson

[57] ABSTRACT

A control circuit and ballasting means controls the light output of a gas discharge lamp in response to switches that are external to the ballast. The invention provides 3 levels of light output with single or multiple lamps. One embodiment of the invention can be mounted in a standard three-way socket for incandescent lamps. Another embodiment can be used to control multiple lamps in a ceiling-mounted fixture, replacing an inboard/outboard configured multiple ballast circuit. Other embodiments provide circuits that allow conventional dimming ballasts which are designed to be controlled with a low-voltage DC input signal to be controlled by a pair of switches connected to an AC power source.

27 Claims, 7 Drawing Sheets

THREE-WAY FLUORESCENT ADAPTER

BACKGROUND OF THE INVENTION

This invention relates to a control circuit and ballasting means for controlling the light output of a gas discharge lamp in response to switches that are external to the ballast. The invention provides 3 levels of light output with single or multiple lamps. One embodiment of the invention can be mounted in a standard three-way socket for incandescent lamps. Another embodiment can be used to control multiple lamps in a ceiling-mounted fixture, replacing an inboard/outboard configured multiple ballast circuit. Other embodiments provide circuits that allow conventional dimming ballasts which are designed to be controlled with a low-voltage DC input signal to be controlled by a pair of switches connected to an AC power source.

Three-way incandescent lamp sockets generate three light levels by switching two filaments in an incandescent bulb on and off. At the lowest setting, the low wattage filament is turned on. At the intermediate setting, the high wattage filament is turned on. At the high setting, both the high and the low wattage filaments are turned on. Prior attempts at using a gas discharge lamp with a three-way socket have resulted in implementations with various drawbacks.

One such implementation with a three-way socket dimmer is illustrated by U.S. Pat. No. 5,309,062. This patent shows turning on 1, 2 or 3 separate gas discharge tubes using a standard three-way incandescent socket. This approach has several disadvantages. The most serious problem is that the switch in a standard three-way socket is not capable of safely interrupting high-voltage high-frequency lamp current. Another disadvantage of this approach is that special three-section lamps are required. Dimming is accomplished by switching off one or more sections. The light distribution will be uneven at dimmed settings since unlit sections will block light from whatever sections are lit.

U.S. Pat. No. 5,424,610 to Pelton describes a three-way adapter for compact fluorescent lamps that uses two separate ballast circuits coupled to one lamp to provide three light levels. This approach is complicated, bulky, and costly.

SUMMARY

A three-way fluorescent adapter for interfacing a standard three-way incandescent lamp socket with at least one gas discharge lamp is disclosed. The adapter has three AC input terminals for receiving inputs from a switched AC line source. The circuit has a rectifier for providing a DC bulk voltage from the AC line source. The adapter further has a control signal generator for deriving a control signal from the voltages present between the AC input terminals in response to the position of the three-way socket switch. An electronic ballast powered from the DC bulk voltage and responsive to the control signal is provided such that the intensity of one or more gas discharge lamps is varied according to the position of the three-way socket switch. Other embodiments utilize a pair of switches and a signal generator to control a dimming ballast.

DETAILED DESCRIPTION OF THE PREFERRED EMBODIMENTS

Figure 1:
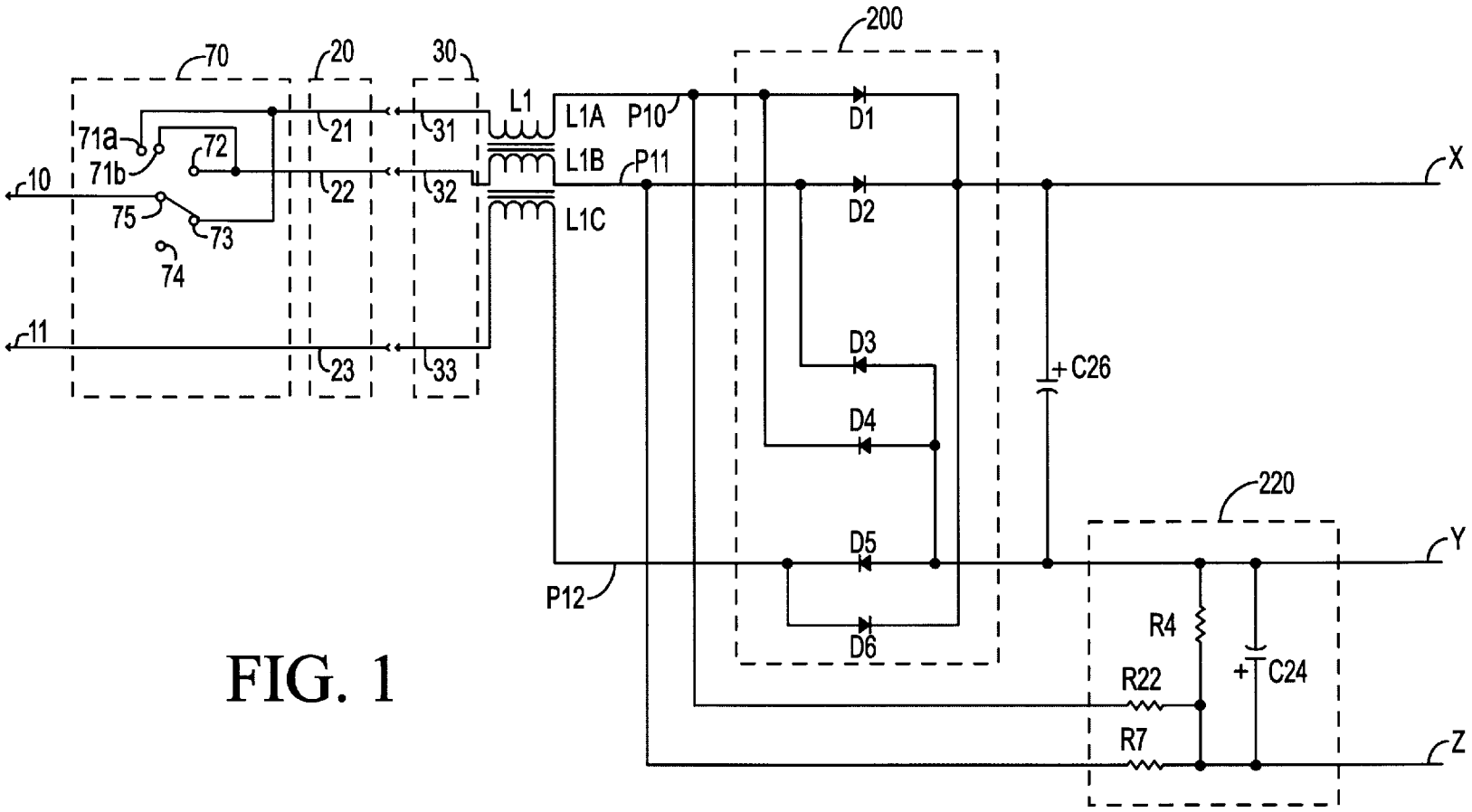
FIG. 1 is an electrical schematic diagram of a three-way lamp socket connected to the rectifier and control signal generator portions of a preferred embodiment of a three-way fluorescent adapter.

Referring to FIG. 1, a three-way switch assembly 70 receives AC power through a pair of input terminals 10 and 11. Three-way switch assembly 70 has a set of switch contacts 71*a*, 71*b*, 72, 73, and 74 that are selectively connected to a wiper 75. Contact 74 is the off position. When wiper 75 is rotated to a low light level position, contact 73 closes. When wiper 75 is further rotated to a medium light level position, contact 73 opens and a contact 72 closes. When wiper 75 is rotated further still to a high light level position, contact 72 opens and contacts 71*a* and 71*b* close.

A three-way socket assembly 20 is connected to three-way switch assembly 70. Three-way socket assembly 20 is designed to accept standard three-way incandescent lamps. Socket assembly 20 has a center contact 22, an intermediate contact 21, and a threaded return contact 23. Three-way switch assembly 70 and three-way socket assembly 20 are typically contained within a table lamp (not shown). Screw-base 30 and the other elements that follow in this description are contained within the three-way fluorescent lamp adapter of the present invention.

Screwbase 30 has three contacts that mate with the contacts of socket 20. Screwbase 30 has a shell contact 33 which has threads that are engaged into the threads in return contact 23 of socket 20 as the fluorescent lamp adapter is rotated. The rotation of screwbase 30 into socket 20 provides mechanical attachment as well as an electrical connection. A tip contact 32 electrically connects with center contact 22. A ring contact 31 electrically connects with intermediate contact 21.

Contacts 31, 32, and 33 are connected to a rectifier 200 through L1, which is a three-conductor common-mode inductor that serves as an electromagnetic interference (EMI) filter. Rectifier 200 consists of diodes D1, D2, D3, D4, D5, and D6 which are connected to form a rectifier bridge. Rectifier 200 has AC input terminals P10, P11, and P12 that are coupled, respectively, to contacts 31, 32 and 33 through windings L1A, L1B, and L1C of inductor L1. Rectifier 200 has a positive output terminal X and a negative output terminal Y that are connected to a bulk storage capacitor C26. If desired, power factor correction circuitry can be inserted between the rectifier output and capacitor C26.

For the low light level switch setting, the AC line voltage is applied between ring contact 31 and shell contact 33. In this case, Diodes D1, D4, D5, and D6 rectify the AC line voltage, charging bulk capacitor C26. For the medium light level switch setting, the AC line voltage is applied between tip contact 32 and shell contact 33. In this case Diodes D2, D3, D5, and D6 rectify the AC line voltage, charging bulk capacitor C26. For the high light level switch setting, the AC line voltage is applied between shell contact 33 and both tip contact 32 and ring contact 31. In this case Diodes D1, D2, D3, D4, D5, and D6 conduct, charging capacitor C26.

A control signal is generated by a control signal generator 220. Control signal generator 220 has a voltage divider network made up of resistors R7, R22, and R4. R4 is connected between terminals Z and Y. R7 is connected between terminal P11 and terminal Z. R22 is connected between terminal P10 and Z. The voltage between terminal Z and terminal Y is the control voltage, and it is designated Vz. A filter capacitor C24 is connected between terminals Z and Y.

The operation of the control signal circuit is illustrated as follows. For the low light level, the sinusoidal AC line voltage, which has an rms value denoted as Vac volts, is applied between ring contact 31 and shell contact 33. The voltage across R22 is approximately a half-wave rectified sine wave, and the voltage across R7 is essentially zero. Because of C24, the voltage developed across resistor R4 is proportional to the average voltage across resistor R22. Consequently, the magnitude of control voltage Vz can be approximated by the formula:

$$Vz(\text{low}) \approx Vac\frac{\sqrt{2}}{\pi}\ \frac{R_4}{R_4+R_{22}} \tag{1}$$

For the medium light level, the AC line voltage is applied between tip contact 32 and shell contact 33. The voltage across R7 is approximately a half-wave rectified sine wave, and the voltage across R22 is essentially zero. In this case, the magnitude of control voltage Vz can be approximated by the formula:

$$Vz(\text{medium}) \approx Vac\frac{\sqrt{2}}{\pi}\ \frac{R_4}{R_4+R_7} \tag{2}$$

For the high light level, the AC line voltage is applied between shell contact 33 and both tip contact 32 and ring contact 31. The voltage across each of resistors R7 and R22 is approximately a half-wave rectified sine wave. In this case, the magnitude of control voltage Vz can be approximated by the formula:

$$Vz(\text{high}) \approx Vac\frac{\sqrt{2}}{\pi}\ \frac{R_4}{R_4+\frac{(R_7)(R_{22})}{(R_7+R_{22})}} \tag{3}$$

Equations (1–3) are based on the assumption that Vz is small compared to the peak value of Vac. If that assumption is correct, then Vz(high) is approximately the sum of Vz(low) and Vz(medium). For example:

Let Vac=120 volts, Vz(low)=1.5 volts, Vz(medium)=3 volts, and $R_4$=10 kΩ.

By Eq. (1) $R_{22}$=350 kΩ.

By Eq. (2) $R_7$=170 kΩ.

By Eq. (3) Vz(high)=4.34 volts, which is approximately 1.5 volts+3 volts.

Figure 3:
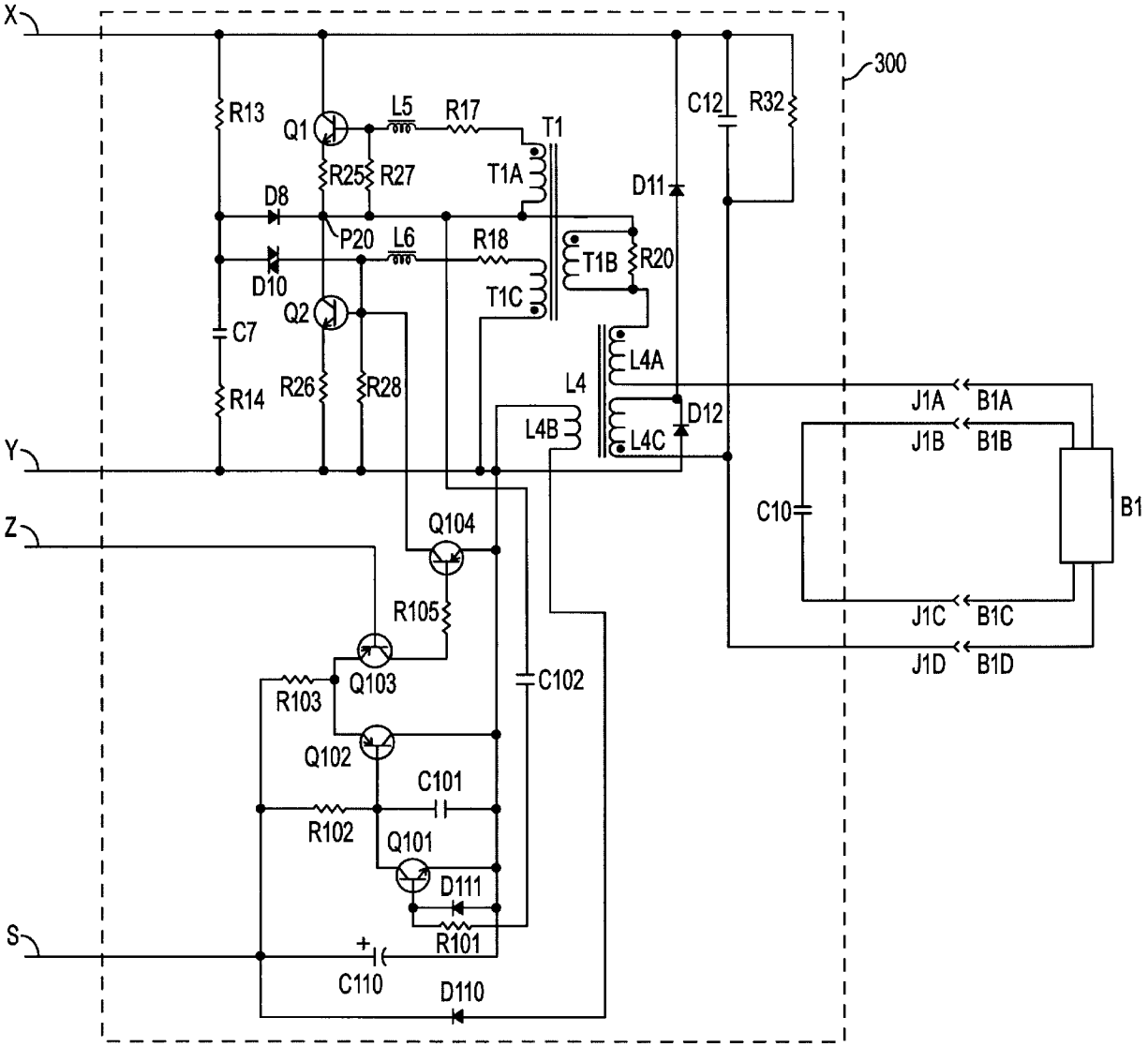
FIG. 3 shows an electrical schematic diagram of a variable-output electronic ballast that may be connected to any of the rectifier and control signal generator circuits of FIG. 1, 2, 4, or 5.

Referring to FIG. 3, an embodiment of a dimming ballast 300 is shown. A complete adapter circuit can be formed by connecting the dimming ballast to the rectifier and control signal generator of FIG. 1 through terminals X, Y and Z. Terminal S is used with the circuits of FIGS. 4 and 5.

A pair of transistors Q1 and Q2 form a half-bridge inverter circuit for converting the bulk DC voltage between terminals X and Y into a high frequency square wave output voltage between terminal P20 and terminal X. The square wave inverter output voltage is applied to a series resonant circuit comprised of a winding L4A on an inductor L4, and capacitors C10 and C12. Capacitor C12 also functions as a DC blocking capacitor.

Ballast 300 has a set of output terminals, J1A, J1B, J1C, and J1D that are connected to the resonant circuit. A gas discharge lamp B1 is connected to the output terminals through lamp terminals B1A, B1B, B1C, and B1D. Lamp B1 is effectively connected in parallel with capacitor C10 since the terminals at each end of lamp B1 are connected by a lamp filament.

Dimming of the gas discharge lamp is accomplished by varying the symmetry of the inverter square wave output voltage. The duty cycle of transistor Q2 is decreased in accordance with the amount of dimming required. The resonant circuit responds mainly to the fundamental component of the inverter output voltage. Maximum current is delivered to the load when the inverter voltage is symmetrical (i.e., when the duty cycle of each pulse width in the inverter is 50%). When the duty cycle diverges from 50% in either transistor, less current is delivered to the lamp because the fundamental component of the inverter voltage is reduced.

Figure 2:
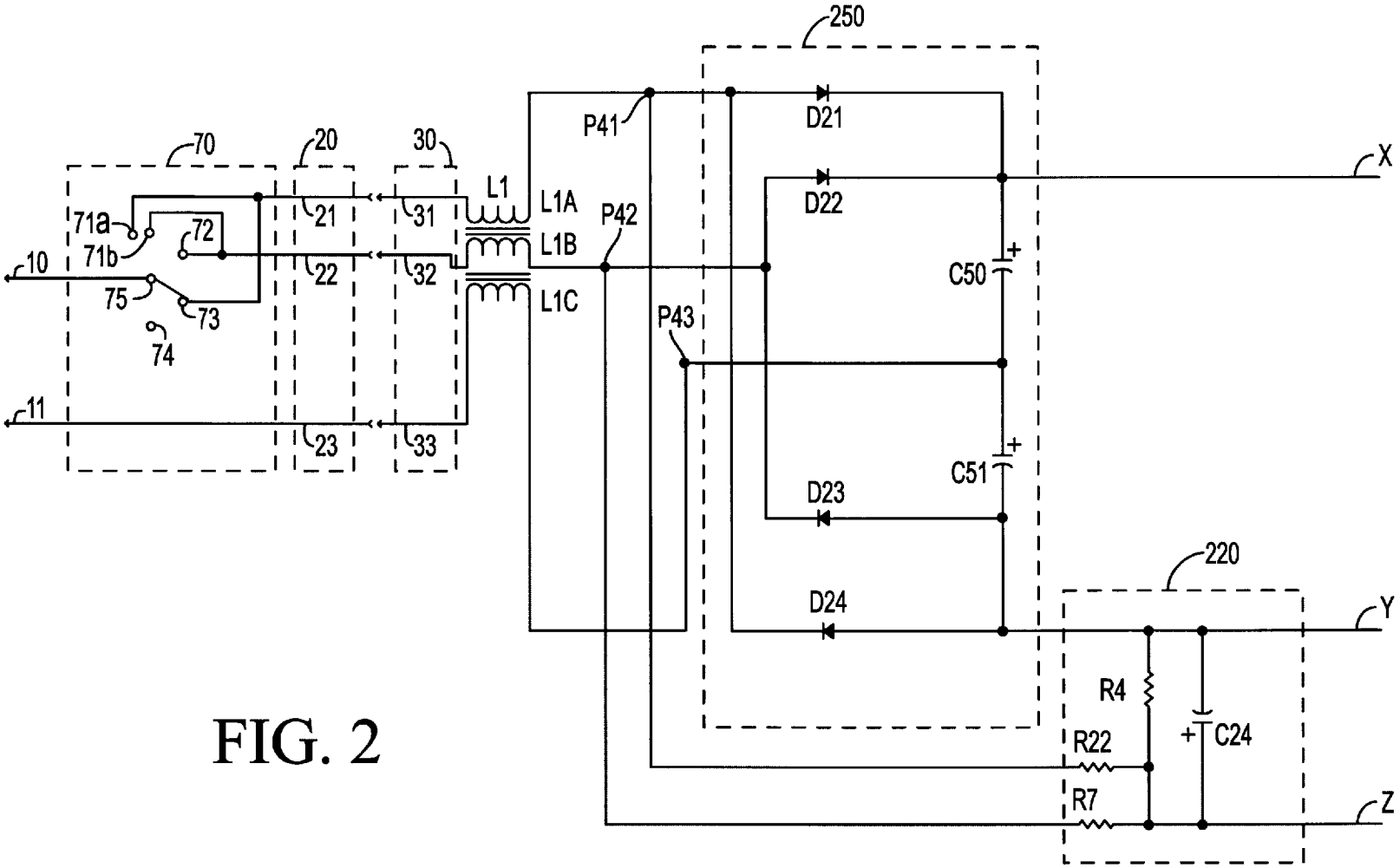
FIG. 2 is an electrical schematic diagram of a three-way lamp socket connected to the rectifier and control signal generator portions of another embodiment of a three-way fluorescent adapter that uses a voltage doubler rectifier to boost the DC bulk voltage.

Control signal Vz is supplied between terminals Y and Z from a control signal generator such as circuit 220 that is shown in FIGS. 1 and 2. Transistors Q101, Q102, Q103, and Q104 form a symmetry control circuit. A power supply for the symmetry control circuit is formed from a winding L4B on inductor L4, a diode D110, and a filter capacitor C10. This power supply provides a voltage of about 10 volts between terminals S and Y.

A capacitor C102 and a resistor R101 couple a signal related to the inverter square wave output voltage to the base of transistor Q101. A diode D111 prevents excessive reverse bias on the base of transistor Q101. As long as transistor Q1 is on, transistor Q101 will be on and capacitor C101 will be discharged. When transistor Q2 turns on, transistor Q101 is turned off and capacitor C101 is charged through a resistor R102. A resistor R103 supplies current to a pair of transistors, Q102 and Q103, that function as a differential comparator. The voltage across capacitor C101 is compared to the control voltage Vz. The maximum value of Vz should be less than the emitter-to-base reverse breakdown voltages of transistors Q102 and Q103.

When transistor Q2 is first turned on, C101 is discharged, and the base of transistor Q102 is pulled to a low level. Transistor Q102 is on, and transistor Q103 is off. Transistor Q103 turns on when the ramp voltage across C101 rises to a level slightly above the value of Vz. When transistor Q103 is turned on, a current flows through a resistor R105, turning on transistor Q104. Transistor Q104 then shorts across the base of transistor Q2. The time at which transistor Q104 turns on depends on the value of Vz. If Vz is sufficiently high, then transistor Q2 will operate at a 50 percent duty cycle because transistor Q2 will already be off when transistor Q104 is turned on. When Vz is below a certain value, transistor Q2 will be turned off early, and the lamp current will be reduced.

A diac D10, a diode D8, a capacitor C7, and resistors R13 and R14 are connected to form a starting circuit for the inverter. Shortly after power is applied to the adapter, the starting circuit supplies a current pulse to transistor Q2 which causes the inverter circuit to begin operating. A resistor R32 aids starting by ensuring that capacitor C12 is initially discharged. After the inverter has been started, a pair of diodes D11 and D12 limit the voltage across the lamp to a level that will allow the lamp to start after the filaments have been heated by the current flowing through capacitor C10.

A transformer T1 having a saturable toroid core provides base drive current for transistors Q1 and Q2. Before T1 saturates, it operates as a current transformer, and the volt-seconds across windings T1A and T1B are set by resistors R17 and R18. Consequently, these resistors can be adjusted to set the operating frequency of the inverter. Resistors R25 and R26 are connected in series with the emitters of transistors Q1 and Q2 to provide negative feedback that stabilizes the inverter operating frequency. A resistor R27 is connected from the base to the emitter of transistor Q1, and a resistor R28 is similarly connected to Q2. These resistors force the inverter to stop oscillating if lamp B1 is removed. Inductors L5 and L6 are connected in series with resistors R17 and R18 to reduce the turn-off losses of transistors Q1 and Q2.

If the lamp operating voltage is sufficiently high, the level of bulk DC voltage provided by rectifier circuit 200 of FIG. 1 may be lower than what is required for optimal efficiency in the inverter circuit. Referring now to FIG. 2, an alternative embodiment of the rectifier and control signal generator portions of a three-way fluorescent adapter is shown. This circuit uses a voltage-doubler rectifier circuit 250 which provides a bulk DC voltage that is approximately twice the value of the voltage obtained from rectifier circuit 200. Three-way switch assembly 70, three-way socket assembly 20, screwbase 30 and EMI filter L1 are the same as in FIG. 1. A dimming ballast such as the one shown in FIG. 3 can be connected to terminals X, Y, and Z to form a complete adapter circuit.

Rectifier 250 has AC input terminals P41, P42, and P43 that are connected to the three windings of EMI filter inductor L1. Terminal P43 is connected to the junction of bulk storage capacitors C50 and C51. Diodes D21 and D24 are connected as a voltage-doubling rectifier between terminal P41 and capacitors C50 and C51. Diodes D22 and D23 are similarly connected between terminal P42 and capacitors C50 and C51. Positive output terminal X is connected to capacitor C50 and negative output terminal Y is connected to capacitor C51.

For the low light level switch setting, the AC line voltage is applied between ring contact 31 and shell contact 33. In this case, diodes D21 and D24 conduct, charging capacitors C50 and C51. For the medium light level switch setting, the AC line voltage is applied between tip contact 32 and shell contact 33. In this case, diodes D22, and D23 conduct, charging capacitors C50 and C51. For the high light output switch setting, the AC line voltage is applied between shell contact 33 and both tip contact 32 and ring contact 31. In this case, diodes D21, D22, D23, and D24 conduct, charging capacitors C50 and C51.

Control circuit 220 is the same as in FIG. 1 except that the resistor values may be different. Resistor R22 is connected to terminal P41 and resistor R7 is connected to terminal P42. The operation of the control circuit is illustrated as follows. For the low light level setting, the voltage across resistor R22 is approximately a raised sine wave that has an average value equal to the peak value of the AC input voltage Vac. The voltage across resistor R22 is essentially zero. The magnitude of the control voltage Vz can therefore be approximated by the formula:

$$Vz(\text{low}) \approx Vac\sqrt{2}\ \frac{R_4}{R_4+R_{22}} \tag{4}$$

For the medium light level setting, the AC line voltage is applied between tip contact 32 and shell contact 33. The voltage across resistor R7 is approximately a raised sine wave that has an average value equal to the peak value of the AC input voltage. In this case, the magnitude of the control voltage Vz can be approximated by the formula:

$$Vz(\text{medium}) \approx Vac\sqrt{2}\ \frac{R_4}{R_4+R_7} \tag{5}$$

For the high light level setting, the AC line voltage is applied between shell contact 33 and both tip contact 32 and ring contact 31. In this case, the magnitude of the control voltage Vz can be approximated by the formula:

$$Vz(\text{high}) \approx Vac\sqrt{2}\ \frac{R_4}{R_4+\frac{(R_7)(R_{22})}{(R_7+R_{22})}} \tag{6}$$

Equations (4–6) are based on the assumption that Vz is small compared to the peak value of Vac. If that assumption is correct, then Vz(high) is approximately the sum of Vz(low) and Vz(medium)

Figure 4:
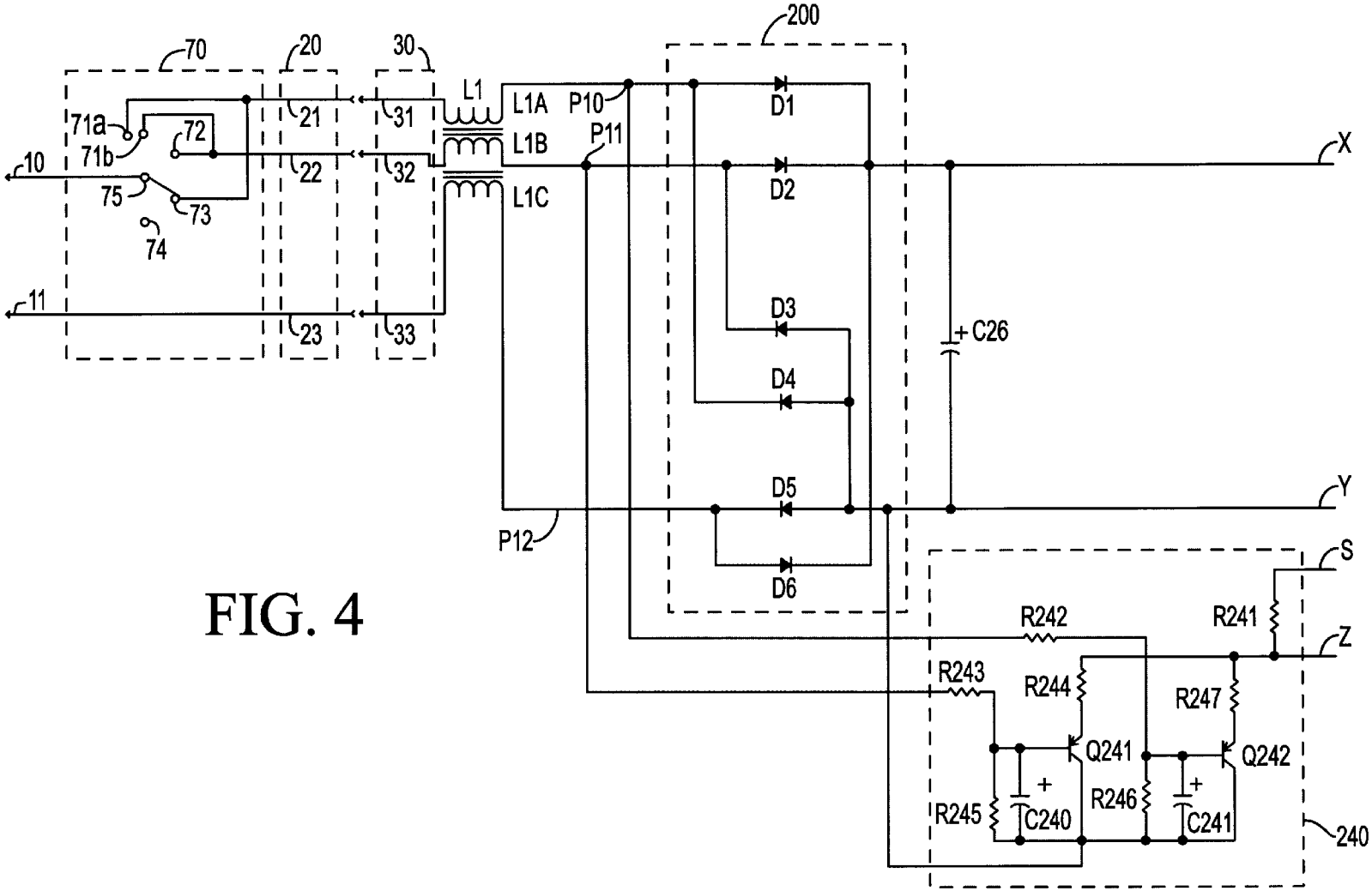
FIG. 4 is an electrical schematic diagram of a three-way lamp socket connected to an alternate rectifier and control signal generator circuit.

Referring now to FIG. 4, the rectifier circuit of FIG. 1 is shown connected to a control signal generator 240 that, unlike control signal generator 220, allows the three light levels to be set independently. Terminals S, Y, and Z are connected to a dimming ballast such as the one shown in FIG. 3. A voltage Vs of approximately 10 volts is supplied by the dimming ballast between terminals S and Y. The voltage Vz between terminals Z and Y controls the output level of the dimming ballast.

Control circuit 240 contains a switched voltage divider consisting of resistors R241, R244, and R247, and transistors Q241 and Q242. These transistors are each controlled by a filtered voltage divider which determines the base-to-collector voltage. The voltage between the base and collector of transistor Q241 is denoted Vbc1, and the corresponding voltage for transistor Q242 is denoted Vbc2. Vbc1 is supplied by a filtered voltage divider consisting of resistors R243, R245, and a capacitor C240. Similarly, Vbc2 is supplied by a filtered voltage divider consisting of resistors R242, R246, and a capacitor C241. Transistor Q241 is turned off when Vbc1 is high enough to reverse bias the emitter-base junction. Transistors Q241 is turned on when Vbc1 is approximately zero, which occurs when the AC line voltage is not present between terminals P11 and P12. During the on state, the emitter to collector voltage is approximately 0.7 volts. Transistor Q242 is controlled by the voltage between terminals P10 and P12, and operates in the same manner as transistor Q241.

When switch 70 is in the low light level position, transistor Q241 is off and transistor Q242 is on. The control voltage Vz is found by:

$$V_z(\text{low}) = 0.7 + \frac{R_{244}}{R_{242}+R_{244}}\ (V_s - 0.7) \tag{7}$$

When switch 70 is in the medium light level position, transistor Q241 is on and transistor Q242 is off. The control voltage Vz is found by:

$$V_z(\text{medium}) = 0.7 + \frac{R_{247}}{R_{241} + R_{247}} (V_s - 0.7) \quad (8)$$

When switch 70 is in the high light level position, transistors Q241 and Q242 are both off, and Vz is pulled high by R241. In this circuit, the maximum value of Vz, Vz(high) is independent of the values of Vz(low) and Vz(medium). Control circuit 240 therefore allows the low light level to be very low while still having a substantial difference between the medium and high light levels.

When either the low or the high light level is selected, transistor Q241 should be off. In order to ensure this condition, the values of resistors R243 and R245 should be selected so that Vbc1 is greater than or equal to Vs when the AC line voltage Vac is present between terminals P11 and P12. The magnitude of Vbc1 can be approximated by the formula:

$$Vbc1 \approx Vac \frac{\sqrt{2}}{\pi} \frac{R_{245}}{R_{243} + R_{245}} \quad (9)$$

The values of resistors R242 and R246 should be selected so that Vbc2 is greater than or equal to Vs when the AC line voltage Vac is present between terminals P10 and P12. The magnitude of Vbc2 can be approximated by the formula:

$$Vbc2 \approx Vac \frac{\sqrt{2}}{\pi} \frac{R_{246}}{R_{242} + R_{246}} \quad (10)$$

Figure 5:
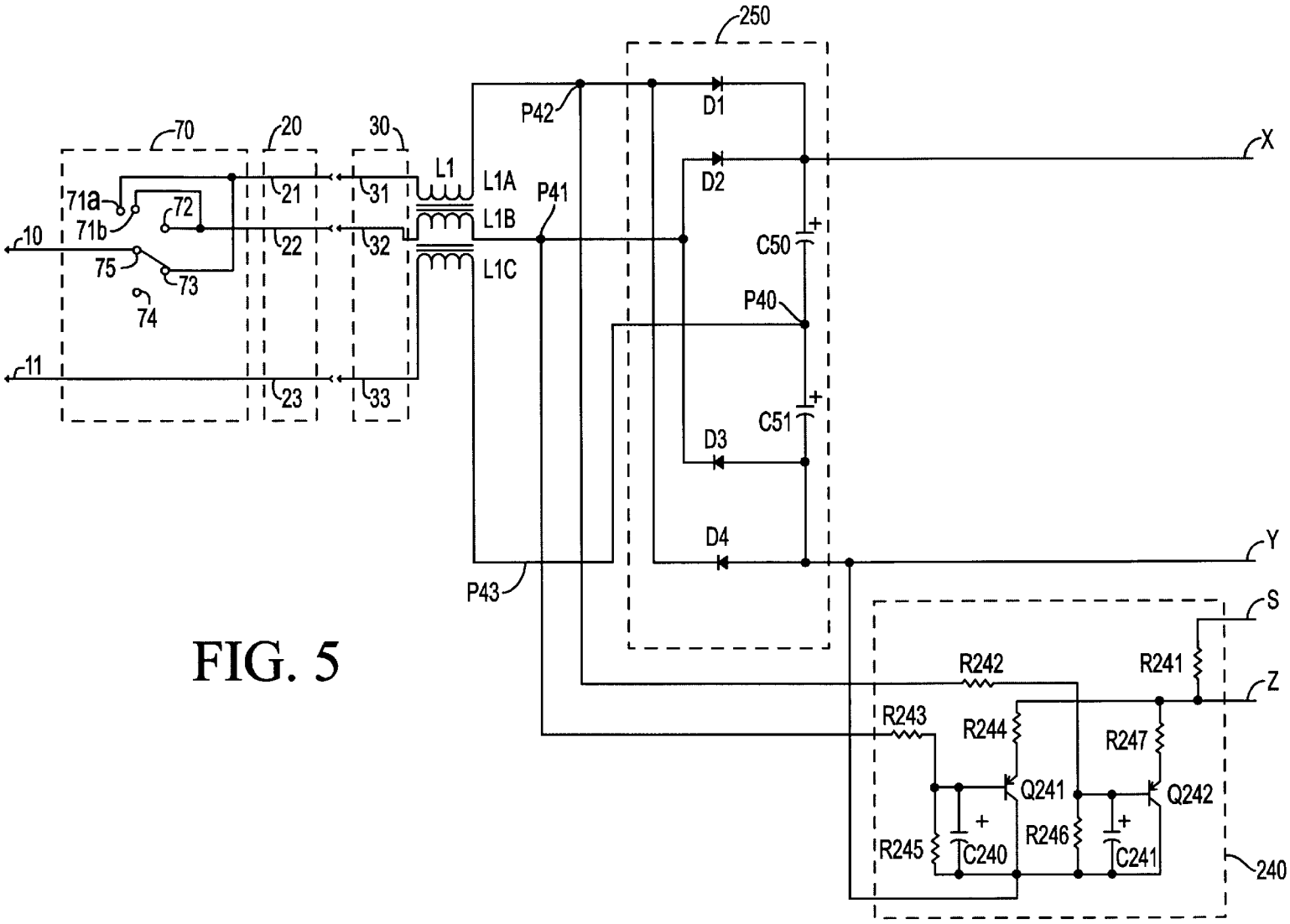
FIG. 5 is an electrical schematic diagram that shows an embodiment which incorporates the voltage doubler rectifier of FIG. 2 with the signal generator scheme of FIG. 4.

Referring now to FIG. 5, the rectifier circuit of FIG. 2 is shown connected to control signal generator 240. Resistor R243 is connected to terminal P41, and resistor R242 is connected to terminal P42. The operation is the same as in FIG. 4 except that the magnitudes of Vbc1 and Vbc2 are approximated with the following formulas:

$$Vbc1 \approx Vac \sqrt{2} \frac{R_{245}}{R_{243} + R_{245}} \quad (11)$$

$$Vbc2 \approx Vac \sqrt{2} \frac{R_{246}}{R_{242} + R_{246}} \quad (12)$$

Equations (9–12) are based on the assumption that the base-to-collector voltages of transistors Q241 and Q242 are small compared to the peak value of Vac.

Figure 6:
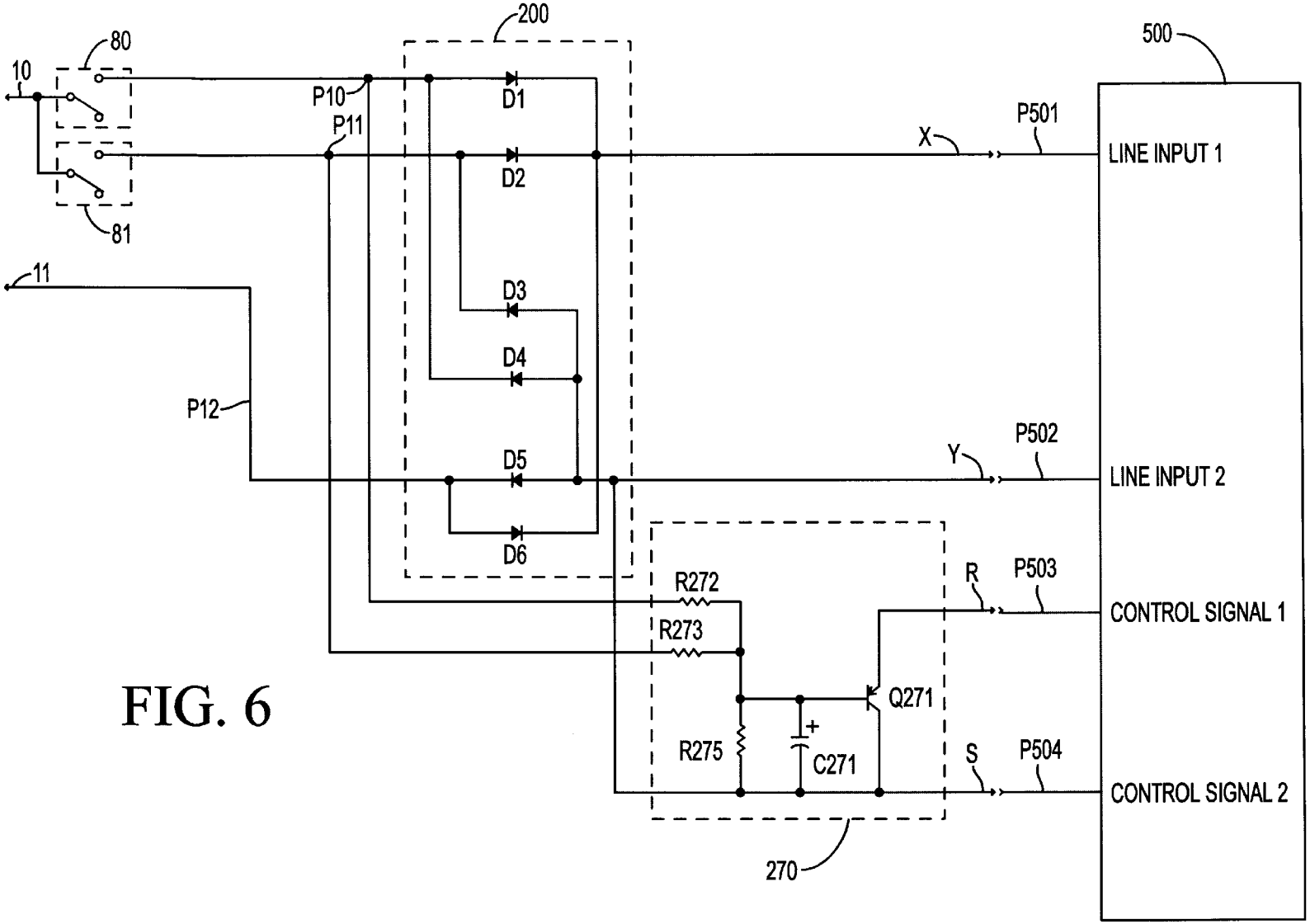
FIG. 6 is an electrical schematic diagram of a three-way interface circuit that allows one or more dimming ballasts to be controlled from a pair of standard wall-mounted switches.

Referring now to FIG. 6, another embodiment of the invention is shown. This embodiment is an interface circuit that allows standard dimming electronic ballasts to be controlled by two standard wall-mounted switches. This embodiment can replace an inboard/outboard configured multiple ballast circuit. The AC line voltage Vac between terminals 10 and 11 is supplied to rectifier 200 through a pair of standard single-pole single-throw wall switches 80 and 81. Three light levels can be obtained by toggling the wall switches.

The unfiltered output of rectifier 200 is connected to terminals X and Y. Most electronic dimming ballasts can operate from a DC supply as well as an AC supply. A dimming ballast 500 has a pair of AC/DC line input terminals P501 and P502 connected to terminals X and Y. Rectifier 200 allows ballast 500 to be powered if either switch 80 or switch 81 is closed.

Ballast 500 is controlled by the voltage Vc present between terminals P503 and P504. Terminal P503 supplies a current that is typically less than 1 mA. The level of Vc is intended to be set by a shunt voltage regulator. A control signal generator 270 has a shunt regulator output that is connected to ballast terminals P503 and P504 through output terminals R and S. Because of the shunt regulator control scheme, additional dimming ballasts can be connected in parallel with ballast 500. The number of ballasts connected in parallel is limited by the current rating of rectifier 200.

The shunt regulation of Vc is accomplished through a PNP transistor Q271, which is connected as an emitter follower. The emitter and collector are connected between terminals R and S. The base is connected to a filtered voltage divider comprised of a capacitor C271 and resistors R272, R273, and R275. Resistor R272 is connected to terminal P10, and resistor R273 is connected to terminal P11.

When switch 80 is closed and switch 81 is open, the value of Vc can be approximated by:

$$Vc \approx 0.7 + Vac \frac{\sqrt{2}}{\pi} \frac{R_{275}}{R_{275} + R_{272}} \quad (13)$$

When switch 81 is closed and switch 81 is open, the value of Vc can be approximated by:

$$Vc \approx 0.7 + Vac \frac{\sqrt{2}}{\pi} \frac{R_{275}}{R_{275} + R_{273}} \quad (14)$$

When switches 80 and 81 are both on, the value of Vc can be approximated by:

$$Vc \approx 0.7 + Vac \frac{\sqrt{2}}{\pi} \frac{R_{275}}{R_{275} + \frac{(R_{272})(R_{273})}{(R_{272} + R_{273})}} \quad (15)$$

In an alternative embodiment, rectifier 200 and control signal generator 270 are contained within ballast 500. Ballast 500 then has three AC input terminals corresponding to terminals P10, P11, and P12. Control signal generator 270 can be replaced with other control signal generator circuits such as circuits 220 or 240.

Figure 7:
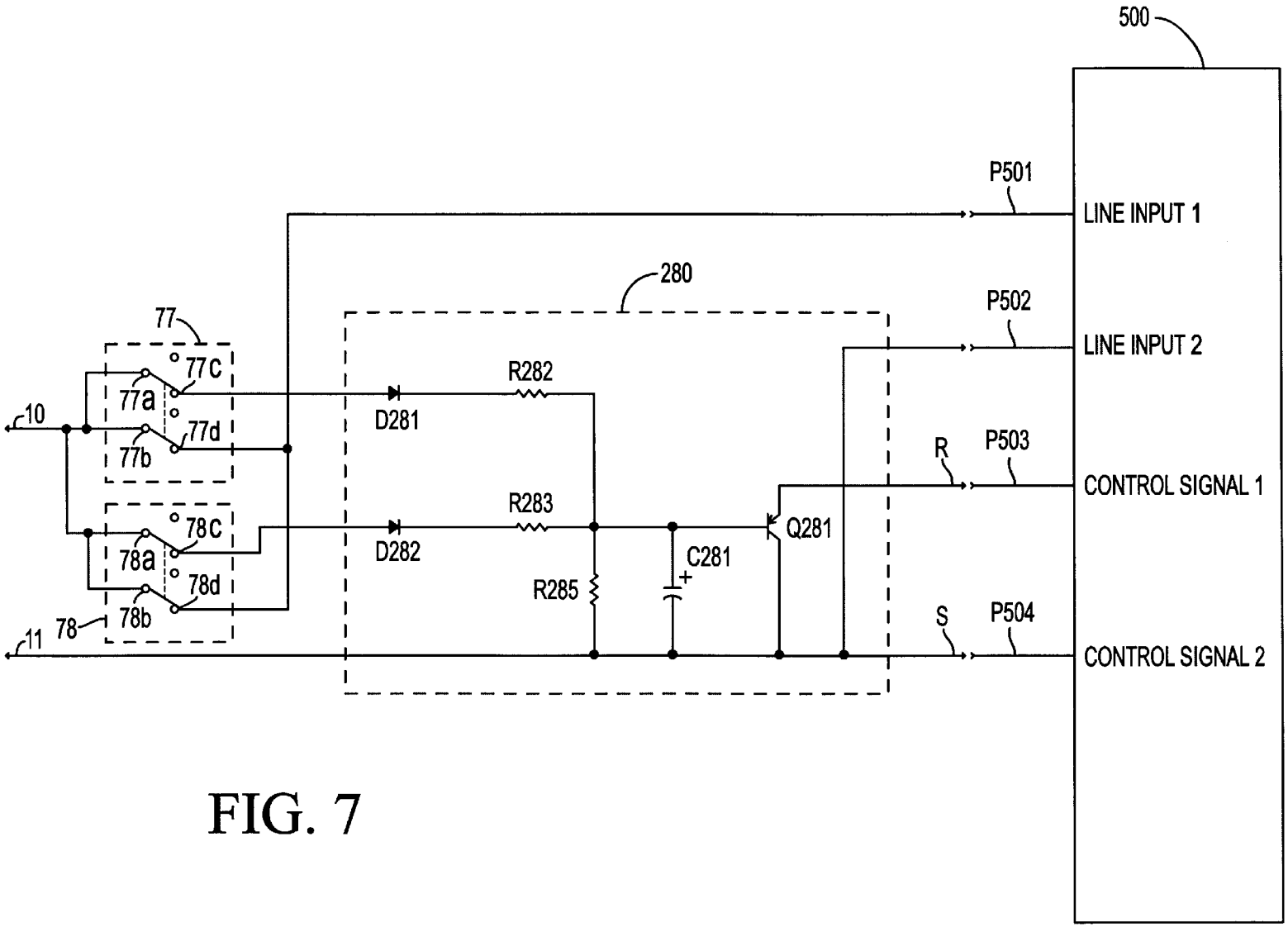
FIG. 7 is an electrical schematic diagram of a three-way interface circuit that allows one or more dimming ballasts to be controlled from a pair of double-pole wall-mounted switches.

Referring now to FIG. 7, another embodiment of the invention is shown. This embodiment is an interface circuit that allows standard dimming electronic ballasts to be controlled by two double-pole single-throw wall-mounted switches. A switch 77 has two input terminals, 77*a* and 77*b*, and two output terminals 77*c* and 77*d*. A switch 78 has two input terminals, 78*a* and 78*b*, and two output terminals 78*c* and 78*d*. Three light levels can be obtained by toggling the wall switches.

AC line voltage Vac is present between terminals 10 and 11. Terminal 11 is connected to terminal P501 of ballast 500. Terminal 10 is connected to input terminals 77*b* and 78*b* of switches 77 and 78. Terminal P501 of ballast 500 is connected to output terminals 77*d* and 78*d* of switches 77 and 78. Input power is supplied to ballast 500 when either switch 77 or switch 78 is closed.

A control signal generator 280 has a shunt regulator output that is connected to ballast terminals P503 and P504 through control terminals R and S. Additional dimming ballasts can be connected in parallel with ballast 500.

The shunt regulation of control voltage Vc is accomplished through a PNP transistor Q281, which is connected as an emitter follower. The emitter and collector are connected between terminals R and S. The base is connected to a filtered voltage divider comprised of a capacitor C281 and resistors R282, R283, and R285. Resistor R282 is connected to switch terminal 77*c* through a diode D281, and resistor R283 is connected to switch terminal 78*c* through a diode D282.

When switch 77 is closed and switch 78 is open, the value of Vc can be approximated by:

$$Vc \approx 0.7 + Vac\frac{\sqrt{2}}{\pi}\ \frac{R_{285}}{R_{285}+R_{282}} \tag{16}$$

When switch 78 is closed and switch 77 is open, the value of Vc can be approximated by:

$$Vc \approx 0.7 + Vac\frac{\sqrt{2}}{\pi}\ \frac{R_{285}}{R_{285}+R_{283}} \tag{17}$$

When switches 80 and 81 are both on, the value of Vc can be approximated by:

$$Vc \approx 0.7 + Vac\frac{\sqrt{2}}{\pi}\ \frac{R_{285}}{R_{285}+\frac{(R_{282})(R_{283})}{(R_{282}+R_{283})}} \tag{18}$$

Equations (13–18) are based on the assumption that the base-to-collector voltages of transistors Q271 and Q281 are small compared to the peak value of Vac. The 0.7 volt term in these equations is due to the emitter-base voltage drop of the emitter follower transistor.

The present invention has been described in connection with a preferred embodiment. It will be understood that many modifications and variations will be readily apparent to those of ordinary skill in the art without departing from the spirit or scope of the invention and that the invention is not to be taken as limited to all of the details herein. Therefore, it is manifestly intended that this invention be limited only by the claims and the equivalents thereof.

What is claimed is:

1. A three-way fluorescent adapter for interfacing a three-way lamp socket with at least one gas discharge lamp comprising:

first and second input terminals each for receiving an AC voltage with respect to a neutral input terminal having a peak magnitude;

rectifier means electrically connected to the first and second input terminals and to the neutral input terminal, for providing a DC bulk voltage from the AC voltage to positive and negative DC output terminals, comprising a voltage doubler for increasing the DC bulk voltage to a magnitude greater than the peak magnitude of the DC voltage;

control signal generating means for deriving a control signal from the AC voltage in response to the position of a three-way switch; and ballast means powered from the DC bulk voltage provided by the rectifier means and responsive to the control signal such that the gas discharge lamp or lamps provide a plurality of light intensities according to the position of the three-way switch.

2. A three-way fluorescent adapter according to claim 1, wherein the rectifier means further comprises:

a first diode having an anode and a cathode;

the first input terminal connected to the anode of the first diode;

a second diode having an anode and a cathode, the cathode of the first diode connected to the cathode of the second diode;

the second input terminal connected to the anode of the second diode;

a third diode having an anode and a cathode, the cathode of the third diode connected to the anode of the second diode;

a fourth diode having an anode and a cathode, the anode of the fourth diode connected to the anode of the third diode, and the cathode of the fourth diode connected to the anode of the first diode;

a first capacitor and a second capacitor series connected, the series capacitor combination connected between the anode of the third diode and the cathode of the second diode;

the neutral input terminal connected between the first and the second capacitors;

the positive DC output terminal connected to the cathode of the first diode; and the negative DC output terminal connected to the second capacitor.

3. A three-way fluorescent adapter according to claim 1, wherein the control signal generating means comprises a voltage divider directly coupled to the negative DC output terminal and to the first and second input terminals.

4. A three-way fluorescent adapter according to claim 3, wherein the network of resistors and capacitors comprises:

a first resistor connected between the first input terminal and a control signal output terminal;

a second resistor connected between the second input terminal and the control signal output terminal;

a third resistor connected between the negative DC output terminal and the control signal output terminal; and a filter capacitor connected between the control signal output terminal and the negative DC output terminal, whereby as the three-way switch is rotated, the first, the second and the third resistors develop the control signal at the control signal output terminal, the control signal having a plurality of magnitudes that vary in accordance with the three-way switch position.

5. A three-way fluorescent adapter according to claim 1, wherein the control signal generating means comprises a transistor sinking network means for independently adjusting each of the plurality of light intensities.

6. A three-way fluorescent adapter according to claim 5, wherein the transistor sinking network means comprises:

a first transistor having a base, an emitter and a collector, a first resistor connected between the base and the collector of the first transistor, a second resistor connected between the emitter of the first transistor and a control signal output terminal;

a second transistor having a base, an emitter and a collector, a third resistor connected between the base and the collector of the second transistor, the collector of the first transistor connected to the collector of the second transistor, a fourth resistor connected between the emitter of the second transistor and the control signal output terminal;

a fifth resistor connected between a first input terminal and the base of the second transistor;

a sixth resistor connected between a second input terminal and the base of the first transistor; and a seventh resistor connected between the control signal output terminal and a DC power supply.

7. A three-way fluorescent adapter for interfacing a three-way lamp socket with at least one gas discharge lamp comprising:

first and second input terminals each adapted for receiving an AC voltage with respect to a neutral input terminal;

rectifier means for providing a DC bulk voltage from the AC voltage;

a voltage divider for deriving a control signal from the AC voltage in response to a position of a three-way switch, the voltage divider consisting of a network of resistors and capacitors directly coupled to a negative DC output terminal and to the first and second input terminals; and ballast means powered from the DC bulk voltage provided by the rectifier means and responsive to the control signal such that the gas discharge lamp or lamps provide a plurality of light intensities according to the position of a three-way switch.

8. A three-way fluorescent adapter according to claim 7, wherein the resistor capacitor network comprises:

a first resistor connected between the first input terminal and a control signal output terminal;

a second resistor connected between the second input terminal and the control signal output terminal;

a third resistor connected between a negative DC output terminal and the control signal output terminal;

a filter capacitor connected between the control signal output terminal and the negative DC output terminal, whereby as the three-way switch is rotated to different positions, the first, the second and the third resistors develop the control signal at the output terminal, the control signal having a plurality of magnitudes according to the different positions of the three-way switch.

9. A three-way fluorescent adapter for interfacing a three-way lamp socket with at least one gas discharge lamp comprising:

input terminal means for receiving an AC voltage;

rectifier means for providing a DC bulk voltage from the AC voltage;

a transistor sinking network means for deriving a control signal from the AC voltage in response to rotation of a three-way switch to different positions and for independently adjusting each of a plurality of light intensities; and ballast means powered from the DC bulk voltage provided by the rectifier means and responsive to the control signal such that the gas discharge lamp or lamps provide a plurality of light intensities according to the position of the three-way switch.

10. A three-way fluorescent adapter according to claim 9, wherein the transistor sinking network means comprises:

a first transistor having a base, an emitter and a collector, a first resistor connected between the base and the collector of the first transistor, a second resistor connected between the emitter of the first transistor and a control signal output terminal;

a second transistor having a base, an emitter and a collector, a third resistor connected between the base and the collector of the second transistor, the collector of the first transistor connected to the collector of the second transistor, a fourth resistor connected between the emitter of the second transistor and the control signal output terminal;

a fifth resistor connected between a first input terminal and the base of the second transistor;

a sixth resistor connected between a second input terminal and the base of the first transistor; and a seventh resistor connected between the control signal output terminal and a DC power supply.

11. A three-way fluorescent adapter for interfacing a standard three-way incandescent socket lamp switch with at least one gas discharge lamp comprising:

a first diode having an anode and a cathode;

a first input terminal connected to the anode of the first diode;

a second diode having an anode and a cathode, the cathode of the first diode connected to the cathode of the second diode;

a second input terminal connected to the anode of the second diode;

a third diode having an anode and a cathode, the cathode of the third diode connected to the anode of the second diode;

a fourth diode having an anode and a cathode, the anode of the fourth diode connected to the anode of the third diode and the cathode of the fourth diode connected to the anode of the first diode;

a fifth diode having an anode and a cathode, the anode of the fifth diode connected to the anode of the third and fourth diode;

a third input terminal connected to the cathode of the fifth diode;

a sixth diode having an anode and a cathode, the anode of the sixth diode connected to the cathode of the fifth diode and the cathode of the sixth diode connected to the cathode of the first diode;

a positive DC output terminal connected to the cathode of the second diode;

a negative DC output terminal connected to the anode of the fifth diode, wherein a DC bulk voltage is developed at the DC output terminals when the input terminals are energized by an AC voltage;

a control signal generating means consisting of:

a first resistor connected between the first input terminal and a control signal output terminal;

a second resistor connected between the second input terminal and the control signal output terminal;

a third resistor connected between the negative DC output terminal and the control signal output terminal;

a filter capacitor connected between the control signal output terminal and the negative DC output terminal, whereby the first, the second and the third resistors develop a low-power DC control signal at the control signal output terminal, the control signal having a plurality of magnitudes that vary in accordance with the three-way switch position; and ballast means powered from the DC bulk voltage supplied by the rectifier means and responsive to the low-power DC control signal such that the gas discharge lamp or lamps provide a plurality of light intensities according to the position of the three-way switch.

12. A three-way fluorescent adapter for interfacing a standard three-way incandescent socket lamp switch with at least one gas discharge lamp comprising:

a first diode having an anode and a cathode;

a first input terminal connected to the anode of the first diode;

a second diode having an anode and a cathode, the cathode of the first diode connected to the cathode of the second diode;

a second input terminal connected to the anode of the second diode;

a third diode having an anode and a cathode, the cathode of the third diode connected to the anode of the second diode;

a fourth diode having an anode and a cathode, the anode of the fourth diode connected to the anode of the third diode and the cathode of the fourth diode connected to the anode of the first diode;

a fifth diode having an anode and a cathode, the anode of the fifth diode connected to the anode of the third and fourth diode;

a third input terminal connected to the cathode of the fifth diode;

a sixth diode having an anode and a cathode, the anode of the sixth diode connected to the cathode of the fifth diode and the cathode of the sixth diode connected to the cathode of the first diode;

a positive DC output terminal connected to the cathode of the second diode;

a negative DC output terminal connected to the anode of the fifth diode, wherein a DC bulk voltage is developed at the DC output terminals when the input terminals are energized by an AC voltage;

a first resistor connected between the first input terminal and a first transistor;

a second resistor connected between the second input terminal and a second transistor;

a first transistor and a second transistor being connected between the third input terminal and control output terminals;

the first transistor having a third resistor and a first capacitor connected between the base and the collector of the first transistor;

the second transistor having a fourth resistor and a second capacitor connected between the base and the collector of the second transistor;

whereby the first and second transistors provide a DC control signal at the control signal output terminals, the control signal having a plurality of magnitudes that are substantially lower than the DC bulk voltage and that vary according to the position of the three-way switch; and ballast means powered from the DC bulk voltage supplied by the rectifier means and responsive to the DC control signal such that the gas discharge lamp or lamps provide a plurality of light intensities according to the position of the three-way switch.

13. A three-way fluorescent adapter for interfacing a standard three-way incandescent socket lamp switch with at least one gas discharge lamp comprising:

a first diode having an anode and a cathode;

a first input terminal connected to the anode of the first diode;

a second diode having an anode and a cathode, the cathode of the first diode connected to the cathode of the second diode;

a second input terminal connected to the anode of the second diode;

a third diode having an anode and a cathode, the cathode of the third diode connected to the anode of the second diode;

a fourth diode having an anode and a cathode, the anode of the fourth diode connected to the anode of the third diode and the cathode of the fourth diode connected to the anode of the first diode;

a first capacitor and a second capacitor series connected, the series capacitor combination connected between the anode of the third diode and the cathode of the second diode;

a third input terminal connected between the first and the second capacitors;

a positive DC output terminal connected to the cathode of the first diode;

a negative DC output terminal connected to the anode of the fifth diode, wherein a DC bulk voltage is developed at the DC output terminals when the input terminals are energized by an AC voltage, the DC bulk voltage magnitude characterized by being greater than the magnitude of the AC voltage;

a first resistor connected between the first input terminal and a control signal output terminal;

a second resistor connected between the second input terminal and the control signal output terminal;

a third resistor connected between the negative DC output terminal and the control signal output terminal;

a filter capacitor connected between the control signal output terminal and the negative DC output terminal, whereby the first, the second and the third resistors develop a DC control signal at the control signal output terminal, the control signal having a plurality of magnitudes that are each substantially lower than the DC bulk voltage and that vary according to the three-way switch position; and ballast means powered from the DC bulk voltage supplied by the rectifier means and responsive to the control signal such that the gas discharge lamp or lamps provide a plurality of light intensities according to the position of the three-way switch.

14. A method of interfacing a three-way lamp socket with at least one gas discharge lamp comprising the following steps:

(a) converting an AC voltage into a DC bulk voltage;

(b) generating a DC control signal from the AC voltage in response to the position of a three-way switch; the DC control signal being separate from the DC bulk voltage;

(c) increasing the DC bulk voltage through the use of a voltage doubling circuit comprising a pair of voltage doubling capacitors;

(d) supplying the DC bulk voltage to a ballast circuit; and (e) supplying the DC control signal to the ballast circuit such that the light intensity of the gas discharge lamp or lamps depends on the position of the three-way switch.

15. An electronic ballast for operating a gas discharge lamp load at multiple power levels comprising:

a neutral input terminal, a first AC voltage input terminal, and a second AC voltage input terminal;

a voltage doubling rectifier means having a first rectifier AC input terminal, a second rectifier AC input terminal, and a third rectifier AC input terminal;

the rectifier means further having a positive DC output terminal and a negative DC output terminal which provide a DC output voltage when an AC voltage is applied between at least two of the rectifier AC input terminals;

the first rectifier AC input terminal connected to the neutral input terminal;

the second rectifier AC input terminal connected to the first AC voltage input terminal;

the third rectifier AC input terminal connected to the second AC voltage input terminal;

inverter means having a first DC input terminal, a second DC input terminal, a control input terminal, and output means for coupling power to the gas discharge lamp load;

control means having a first control input terminal connected to the negative DC output terminal, a second control input terminal connected to the first AC voltage input terminal, and a third control input terminal connected to the second AC voltage input terminal; and the control means having an output terminal connected to the inverter means control input terminal.

16. The electronic ballast according to claim 15, wherein the neutral input terminal, the first AC voltage input terminal, and the second AC voltage input terminal are adapted to fit into and receive power from a three-way socket designed to operate a three-way incandescent lamp.

17. The electronic ballast according to claim 15, wherein the rectifier means further comprises:

a first diode having an anode and a cathode;

a second diode having an anode and a cathode;

a third diode having an anode and a cathode;

a fourth diode having an anode and a cathode;

the second rectifier AC input terminal connected to the anode of the first diode and to the cathode of the fourth diode; the third AC input terminal connected to the anode of the second diode and to the cathode of the third diode; the positive DC output terminal connected to the cathodes of the first and the second diodes; the negative DC output terminal connected to the anodes of the third and the fourth diodes; and a first capacitor connected between the positive DC output terminal and the neutral input terminal and a second capacitor connected between the negative DC output terminal and the neutral input terminal.

18. The electronic ballast according to claim 17, wherein the control means consists of:

a first resistor connected between the second control terminal and the control means output terminal, a second resistor connected between the third control input terminal and the control means output terminal, a third resistor connected between the negative DC output terminal and the control means output terminal, and a capacitor connected in parallel with the third resistor.

19. An interface circuit for using first and second switches to control one or more dimmable electronic ballasts each having a pair of control input terminals, comprising:

a dimming control circuit having a first AC input terminal, a second AC input terminal, a neutral input terminal, a first control output terminal, and a second control output terminal;

the first AC input terminal connected to the first switch, the second AC input terminal connected to the second switch, the first and second control output terminals providing a dimming control signal to the control input terminals of each electronic ballast in response to an AC voltage present between at least one of the AC input terminals and the neutral input terminal, the dimming control signal having a magnitude that varies in response to operation of the first and second switches.

20. The interface circuit according to claim 19 wherein each of the first and second switches are single-pole single throw switches, the interface circuit further comprising rectifier means connected to the first and second AC input terminals and having a positive DC output terminal and a negative DC output terminal which provide a DC output voltage to each dimmable electronic ballast.

21. The interface circuit according to claim 20 wherein the dimming control circuit comprises a voltage divider connected to each of the switches.

22. The interface circuit of claim 21 wherein the voltage divider comprises a first resistor connected to the first AC input terminal, a second resistor connected to the second AC input terminal, and a third resistor and a first capacitor connected in parallel between the first and second resistors and the negative DC output terminal.

23. The interface circuit of claim 22 wherein the dimming control circuit further comprises a shunt regulator circuit connected across the first and second control output terminals.

24. The interface circuit of claim 20 wherein each of the first and second switches are double-pole single-throw switches, the dimming control circuit comprising a voltage divider coupled to each of the switches and a shunt regulator circuit connected across the first and second control output terminals.

25. The interface circuit of claim 24 wherein the voltage divider comprises a first resistor, a second resistor, and a third resistor and a first capacitor connected in parallel between the neutral input terminal and the first and second resistors; and the interface circuit further comprising the first resistor connected through a first diode to the first AC input terminal, and the second resistor connected through a second diode to the second AC input terminal.

26. An electronic ballast for operating a gas discharge lamp load at multiple power levels comprising:

a neutral input terminal, a first AC voltage input terminal, and a second AC voltage input terminal;

rectifier means having a first rectifier AC input terminal, a second rectifier AC input terminal, and a third rectifier AC input terminal;

the rectifier means further having a positive DC output terminal and a negative DC output terminal which provide a DC output voltage when an AC voltage is applied between at least two of the rectifier AC input terminals;

the first rectifier AC input terminal connected to the neutral input terminal;

the second rectifier AC input terminal connected to the first AC voltage input terminal;

the third rectifier AC input terminal connected to the second AC voltage input terminal;

inverter means having a first DC input terminal, a second DC input terminal, a control input terminal, and output means for coupling power to the gas discharge lamp load;

control means for generating a lamp intensity control signal, the control means having a first control input terminal directly connected to the neutral input terminal, a second control input terminal directly connected to the first AC voltage input terminal, and a third control input terminal connected to the second AC voltage input terminal;

the control means further comprising a resistive voltage divider; and the control means having an output terminal connected to the inverter means control input terminal.

27. The electronic ballast according to claim 26 further comprising a power factor correction circuit coupled between the rectifier means DC output terminals and the inverter means DC input terminals.

* * * * *